US005459504A

United States Patent [19]

Sato

[11] Patent Number: 5,459,504

[45] Date of Patent: Oct. 17, 1995

[54] THERMAL PRINTER

[75] Inventor: Nobuhiro Sato, Miyagi, Japan

[73] Assignee: Tohoku Ricoh Co., Ltd., Miyagi, Japan

[21] Appl. No.: 106,576

[22] Filed: Aug. 16, 1993

[30] Foreign Application Priority Data

Sep. 25, 1992 [JP] Japan ..... 4-256866

[51] Int. Cl.[6] ..... B41J 13/03; B41J 13/036

[52] U.S. Cl. ..... 347/215; 347/217; 347/218; 347/197; 400/235.1; 400/618; 400/617; 400/636; 400/636.2

[58] Field of Search ..... 400/223, 224.1, 400/235.1, 224.2, 225, 231, 617, 618, 636, 636.2, 637, 637.1, 637.2, 637.3, 634, 641, 637.6, 638, 639; 346/134, 136; 347/215, 217, 218

[56] References Cited

U.S. PATENT DOCUMENTS 4,860,028 8/1989 Ogawa ..... 400/235.1
5,001,498 3/1991 Shimizu et al. ..... 400/618

FOREIGN PATENT DOCUMENTS 62-41809 10/1987 Japan .
2-59068 12/1990 Japan .

*Primary Examiner*—Huan H. Tran
*Attorney, Agent, or Firm*—Armstrong, Westerman, Hattori, McLeland and Naughton

[57] ABSTRACT

The heat transfer ribbon can be held by a heat transfer ribbon feed roller and a heat transfer ribbon pinch roller and can be fed in the direction opposite to the normal feeding direction for printing and also effectively used even if there appears a large blank space between the printed portions on the paper by returning it by the length corresponding to such a blank space. Furthermore, since the heat transfer ribbon feed roller or the heat transfer ribbon pinch roller is provided with a mechanism for applying turning effort to give directly tension to the heat transfer ribbon, a given tension is always applied to the heat transfer ribbon to thereby prevent the wrinkle from generating thereon even if the outer diameter of the heat transfer ribbon wound around a supply roller is varied. Still furthermore, the heat transfer ribbon pinch roller and the paper pinch roller are integrated with each other to form a pinch roller unit for facilitating the assembly thereof and improving the maintenance thereof.

6 Claims, 11 Drawing Sheets

THERMAL PRINTER

BACKGROUND OF THE INVENTION

1. Field of the Invention

The present invention relates to a thermal printer for feeding a heat transfer ribbon and a paper toward and between a platen and a thermal head while the heat transfer ribbon remains laid on top of the paper so that the former is held by the latter, followed by performing printing on the paper by ink which is impregnated in the heat transfer ribbon and is molten by the thermal head when the heat transfer ribbon and the paper are allowed to pass between the platen and the thermal head.

2. Prior Art

In case of printing, e.g. a bar code, etc. on a paper P using a thermal printer as illustrated in FIG. 8, large blank spaces are liable to appear on the paper P between printed portions of the bar codes.

In such a case, if the bar code, etc. are continuously printed on the paper P while the heat transfer ribbon remains laid on top of the paper, the heat transfer ribbon is allowed to pass between the platen and the thermal head while it is not used for printing at the portions corresponding to the blank spaces on the paper P. If the ratio of the blank spaces to the printed portions is high, the heat transfer ribbon is consumed soon, which leads to increase of the running cost.

There is a thermal printer having a mechanism for feeding the heat transfer ribbon in the normal direction toward the thermal head and also in the direction opposite to the normal direction independently of the normal direction wherein the heat transfer ribbon having the portion which is not subjected to printing is reversely fed to the position close to the printing position by the thermal head after a given time lapses every time the printing is completed.

Such a printer is disclosed in, e.g. Japanese Utility Model Publication No. 62-41809. This is explained more in detail with reference to FIG. 12 wherein a heat transfer ribbon 1 can be fed together with or independently of a paper P in the normal direction as denoted at the arrow A or in the direction opposite to the normal direction.

The paper P to be printed thereon is pressed against the outer periphery of a platen 2 by a friction roller 3 at one portion thereof while it remains extended around the platen 2.

The heat transfer ribbon 1 unwound from a supply roller 4 is allowed to pass an ink sheet feed roller 6 and a separation roller 7 which are respectively disposed at both sides of the platen 2 and is wound around a winding roller 5.

A thermal head 8 contacts the platen 2 at the printing position of the paper P and turnably attached to one end of a rod 11 at one end thereof (right side in FIG. 12) and the rod 11 is rotatably attached to a rotary portion of a rotary solenoid 12 at the other end of the rod 11.

Accordingly, when the rotary solenoid 12 rotates, the rod 11 lowers from the position in FIG. 12 to thereby swing the thermal head 8 in the direction as denoted at the arrow B so that the pressing force of the thermal head 8 against the platen 2 can be reduced or the thermal head 8 can be moved away from the platen 2.

The ink sheet feed roller 6 is driven by a stepping motor, not shown. When the ink sheet feed roller 6 is reversely rotated by the stepping motor, it can feed the heat transfer ribbon 1 in the direction opposite to the direction of the arrow A.

Accordingly, when there appears a large blank space between the printed portions, the heat transfer ribbon I and the paper P are fed in the direction of the arrow A whereby the printing is performed on the paper P, thereafter they are still fed in the direction of the arrow A and then the heat transfer ribbon 1 is separated from the paper P. Successively, the stepping motor is reversely rotated to return the heat transfer ribbon 1 by the length corresponding to the blank space so that the heat transfer ribbon can be effectively used.

There is another thermal printer which is disclosed in Japanese Patent Publication No. 2-59068 as illustrated in FIG. 13 wherein a heat transfer ribbon 1 is reversely fed independently of a paper.

In this thermal printer, a paper P to be printed thereon is fed toward and between a thermal head 14 and a platen 15 by way of a plurality of paired feed rollers 13 and 13 and the heat transfer ribbon 1, which is unwound from a supply roller 9 and wound around a winding roller 10, is laid on top of the paper P before the heat transfer ribbon 1 and the paper P reach the thermal head 14. The paper P and the heat transfer ribbon 1 which is laid on top of the paper P are fed toward and between the thermal head 14 and the platen 15 so that the former is held by the latter wherein ink impregnated in the heat transfer ribbon 1 is molten by the thermal head 14 to thereby transfer ink onto the paper P so as to complete the printing.

The thermal head 14 contacts the heat transfer ribbon 1 at a heat sensitive print head 17 which is held integrally by a head block 18. The head block 18 is turnably supported by a supporting shaft 19 so as to turn the entire thermal head 14 in the direction as denoted at the arrow C. After the heat transfer ribbon 1 is unwound or drawn out from the supply roller 9 and extended around a tension arm 21, it is allowed to pass a pinch roller 23 which is pressed by a return feed roller 22 provided with a one way clutch capable of shifting counterclockwise as illustrated in FIG. 13 and resiliency of a spring, not shown, and thereafter it is extended around a guide roller 24 and held between the heat sensitive print head 17 and the platen 15.

Successively, the heat transfer ribbon 1 is extended around a separation roller 25 and thereafter is allowed to pass a pinch roller 27 which is pressed by a return feed roller 26 provided with a one way clutch capable of shifting counterclockwise as illustrated in FIG. 13 and resiliency of a spring, not shown, and thereafter it is extended around a tension arm 28 and then wound around the winding roller 10.

If there appear large blank spaces between the printed portions, the heat transfer ribbon 1 is fed in the direction opposite to the normal feeding direction, i.e. rightward in FIG. 13 every time the printing is completed so as to effectively use and save the heat transfer ribbon 1.

That is, the heat transfer ribbon 1 and the paper P are laid on top of another just before they reach the heat sensitive print head 17 and they are fed toward and between the heat sensitive print head 17 and the platen 15 where the printing is performed and thereafter they remain continuously fed in the same direction. When the printed portion on the paper P where an image is transferred thereon is allowed to pass the separation roller 25 and the heat transfer ribbon 1 is separated from the printed portion on the paper P, a motor, not shown, is reversely rotated to rotate reversely the return feed roller 22 to thereby return the heat transfer ribbon 1 by the length corresponding to the blank space where it is not used for printing, thereafter the printing is repeated in a predetermined timing.

However, since the thermal printer as illustrated in FIG. 12 is structured that the heat transfer ribbon 1 unwound from the supply roller 4 is fed toward the thermal head 8 by the ink sheet feed roller 6 in the direction of the arrow A, there is such a problem that the heat transfer ribbon 1 is not always stably stretched at a given tension between the supply roller 4 and the thermal head 8 since the tension to be applied to the heat transfer ribbon 1 is increased as the outer diameter of the heat transfer ribbon 1 wound around the supply roller 4 is reduced.

This is described more in detail. According to the thermal printer as illustrated in FIGS. 12 and 13, the tension is always applied to the heat transfer ribbon 1 positioned between the supply roller and the thermal head so as to remove the slack on the heat transfer ribbon 1 so that the wrinkle is prevented from generating on the heat transfer ribbon 1.

A mechanism for applying tension is, for example, illustrated in FIG. 14. The mechanism applies a given tension to the heat transfer ribbon 1 which is positioned between the supply roller 4 and the thermal head 8 by applying frictional load to a ribbon supply shaft 29 wherein the frictional load generated by a frictional load generating gear 31 is transmitted to a friction transmitting gear 32 which is integrated with the ribbon supply shaft 29 meshing with the frictional load generating gear 31 whereby the frictional load is transmitted to the ribbon supply shaft 29.

The frictional load generating gear 31 is rotatably supported by a shaft 33 which is fixed perpendicular to a printer side plate 30 as illustrated in FIG. 15 and has a friction generating pad 36 which is integrally attached to one surface thereof. A spring presser 34 is screwed into a tip end side of the shaft 33 and a compression coil spring 35 is mounted between the spring presser 34 and the frictional load generating gear 31. The frictional load generating gear 31 is pressed against the printer side plate 30 by the resiliency of the compression coil spring 35 whereby the friction generating pad 36 is pressed against the printer side plate 30 so that the frictional load generating gear 31 is rotated with a given frictional load.

In such a mechanism, if the frictional load is applied, e.g. to the supply roller 4 as illustrated in FIG. 12 to thereby apply the tension to the heat transfer ribbon 1 which is positioned between the supply roller 4 and the thermal head 8, the following relation is established which is represented by the equation of $T=F/R$ where F is friction to prevent the rotation of the ribbon supply shaft 29, T is the tension applied to the heat transfer ribbon 1 and R is a radius of the heat transfer ribbon 1 which is wound around the supply roller 4. Accordingly, this equation shows that the tension T is increased as the radius R of the heat transfer ribbon 1 wound around the supply roller 4 is reduced. The tension to be applied to the heat transfer ribbon 1 is varied since the radius of the transfer ribbon 1 reduced as the transfer ribbon is used so that the heat transfer ribbon 1 can not be stably stretched at a given tension between the supply roller 4 and the thermal head 8.

In the mechanism as illustrated in FIG. 15, the friction generating pad 36 is worn as time lapses to thereby vary the coefficient of friction so that the frictional load to be applied to the ribbon supply shaft 29 is varied, which leads to the problem of variation of the tension to be applied to the heat transfer ribbon as time lapses.

There is a so-called ON DEMAND operation in the thermal printer which means that both the heat transfer ribbon 1 and the paper P can be fed in the direction opposite to the feeding direction thereof at the same. That is, as illustrated in FIG. 14, the paper P, after it was printed, is cut by a cutter 38 which is positioned understream the thermal head 8 in the paper feeding direction, and thereafter the cut paper P is fed reversely so that the cut portion of the paper P is returned together with the heat transfer ribbon 1 to the printing position where the printing is to be performed by the thermal head 8 and at the same time the next printing is performed on the printing position, i.e., blank space on the cut print paper P so as to save the heat transfer ribbon 1 and the paper P.

In the operation of the so-called ON DEMAND, the heat transfer ribbon 1 is likely to slack and generate the wrinkle thereon upstream the thermal head in the heat transfer heat feeding direction, i.e. at the left side in FIG. 14 when the heat transfer ribbon 1 is returned together with the paper P.

In such a thermal printer, a coil spring 37 is provided between the ribbon supply shaft 29 and the friction transmitting gear 32 in which the ribbon supply shaft 29 rotatably engages and one end of the coil spring 37 is fixed to the ribbon supply shaft 29 wherein the other end thereof is fixed to the friction transmitting gear 32 as illustrated in FIG. 16 (components which correspond to those of FIG. 15 are denoted at the same numerals).

With such an arrangement, when the heat transfer ribbon 1 is unwound around fed from the supply roller 4 by the feeding force of the platen 2, the ribbon supply shaft 29 is rotated in the direction opposite to the winding direction of the coil spring 37 by a given amount to thereby generate turning effort.

The coil spring 37 is twisted until the turning effort of the ribbon supply shaft 29 balances with friction generated by friction between the friction generating pad 36 of the frictional load generating gear 31 and the printer side plate 30. Thereafter, the friction surface of the friction generating pad 36 slips so that the frictional load generating gear 31 idles and the friction transmitting gear 32 engaging with the frictional load generating gear 31 rotates to thereby rotate the ribbon supply shaft 29 while the coil spring 37 remains twisted.

When the heat transfer ribbon 1 is returned together with the paper P owing to the ON DEMAND operation, the twist of the coil spring 37 is returned by the amount of returning of the heat transfer ribbon 1 and the paper P whereby the heat transfer ribbon 1 which is liable to slack is again wound around the supply roller 4, so that the slack of the heat transfer ribbon 1 is removed and the wrinkle is prevented from generating on the heat transfer ribbon 1.

However, the provision of the coil spring 37 increases the number of parts and requires the troublesome assembly thereof, which leads to poor assembling operation thereof.

In the thermal printer as illustrated in FIG. 13, since the heat transfer ribbon 1 which is unwound and fed from the supply roller 9 is held by the return feed roller 22 and the pinch roller 23 until it reaches the thermal head 14, if the mechanism to apply a given tension to the heat transfer ribbon 1 as illustrated in FIG. 15 is provided in the return feed roller 22 or pinch roller 23 the tension is directly applied to the heat transfer ribbon 1 from the return feed roller 22 or pinch roller 23. Although the variation of the tension has been occurred as the outer diameter of the heat transfer ribbon 1 wound around the supply roller is varied when the frictional load is applied to the ribbon supply shaft 29, such variation of the tension does not occur so that the heat transfer ribbon 1 can be always held between the thermal head 14 and the pinch roller 23 at a given tension.

However, the structure to hold the heat transfer ribbon 1 by the rollers at both sides thereof increases the number of the rollers, which leads to much time and labor for assembling the thermal printer and to poor maintenance thereof at the time of replacing the parts thereof with other parts.

Furthermore, in the conventional typical thermal printer, the paper is liable to skew if the thickness thereof is varied. It is preferable that the paper hardly skews even if the kind of paper such as the thickness thereof is varied but it is not performed easily by the conventional arrangement of the thermal printer.

In the arrangement of the thermal printer as illustrated in FIG. 13 for holding and feeding the paper and the feed transfer ribbon by a plurality of paired rollers respectively at both sides thereof, there is such a problem that the stable feeding force can not be obtained since the paper and the heat transfer ribbon can not be held thereby with a uniform pressing force extending in the width direction of the paper and the heat transfer ribbon when a plurality of paired rollers are not disposed in accurately parallel with each other in the axial directions thereof owing to the variation of the accuracy of the parts.

SUMMARY OF THE INVENTION

The present invention has been made to solve the aforementioned problems of the conventional thermal printer and to provide a thermal printer capable of effectively utilizing a heat transfer ribbon even if there appear large blank spaces between the printed portions on the printed paper.

It is a second object of the present invention to provide a thermal printer capable of continuously performing excellent printing on the paper without generating wrinkle on the heat transfer ribbon at the early stage of printing and at the time when the radius of the heat transfer ribbon wound around the supply roller is reduced.

It is a third object of the present invention to provide a thermal printer capable of facilitating assembly of the thermal printer and improving the maintenance thereof.

It is a fourth object of the present invention to provide a thermal printer capable of performing excellent printing on the paper without skewing even if the kind of the paper such as the thickness thereof is varied.

It is a fifth object of the present invention to provide a thermal printer capable of improving operability thereof so as to facilitate the operation in case of setting the heat transfer ribbon or the paper on the thermal printer.

It is a sixth object of the present invention to provide a thermal printer capable of stably feeding the heat transfer ribbon and the paper even if there occurs the variation in the accuracy of the parts thereof.

To achieve the above object, in the thermal printer provided with a heat transfer ribbon feeding means to feed a heat transfer ribbon to the normal direction or the reverse direction opposite to the normal direction for performing printing on a paper, a platen and a thermal head which is pressed against the platen wherein the heat transfer ribbon and the paper are fed in the normal direction and allowed to pass between the platen and the thermal head while the heat transfer ribbon is laid on top of the paper so that ink impregnated in the heat transfer ribbon is molten by the thermal head to thereby perform the printing on the paper, the thermal printer further comprises a paper feed roller and a paper pinch roller for holding and feeding the paper toward and between the platen and the thermal head and a heat transfer ribbon feed roller and a heat transfer ribbon pinch roller respectively provided on the heat transfer feeding means for holding and feeding the heat transfer ribbon in the reverse direction independently of the normal direction.

Furthermore, in the thermal printer as set forth above, the paper pinch roller and the heat transfer ribbon pinch roller are respectively integrated with each other to form a pinch roller unit which is detachably attached to a body of the thermal printer wherein the paper pinch roller and the heat transfer pinch roller are respectively set on the positions where the paper pinch roller can feed the paper and the heat transfer ribbon pinch roller can feed the heat transfer ribbon when the pinch roller unit is mounted on the body of the thermal printer.

With such an arrangement of the thermal printer, the heat transfer ribbon is held by the heat transfer ribbon feed rollers and the heat transfer ribbon pinch roller which are respectively paired with each other, if these roller have a mechanism to apply tension directly to the heat transfer ribbon, it is possible to extend the heat transfer ribbon at a given tension regardless of the amount of reduction of the ribbon at the side of the supply roller so that the heat transfer ribbon is prevented from generating wrinkle thereon. Even if the number of the rollers is increased by provision of the paired of heat transfer ribbon feed roller and heat transfer ribbon pinch rollers, the thermal printer can be easily assembled and the maintenance thereof is improved since the paper pinch roller and the heat transfer ribbon pinch roller are integrated with each other to form the pinch roller unit.

Since the heat transfer ribbon can be reversely fed by the ribbon feeding means independently of the normal feeding direction, even if there appears a large blank space between the printed portions on the paper, the heat transfer ribbon can be fed reversely so as to return the non-used portion thereof to the printing position after the completion of the printing while the heat transfer ribbon is laid on top of the paper and is allowed to pass between the thermal head and the platen and thereafter the heat transfer ribbon is separated from the paper, which leads to most effective use of the heat transfer ribbon avoiding the waste thereof.

If a unit inclination angle adjusting mechanism is provided on the pinch roller unit for inclining the entire pinch roller unit so as to incline the advancing direction of the paper in the width direction thereof, the advancing direction of the paper can be inclined by the simple operation to incline the entire pinch roller unit so that the paper is certainly prevented from skewing by aligning the side edge of the inclined paper with a standard surface thereof.

If the inclination angle is adjusted properly, the paper to be printed can be fed without skewing even if the papers to be printed are of different kind such as thin papers.

If there are provided in the thermal printer a thermal head pressing release mechanism for releasing the pressing of the thermal head against the platen and a pinch roller separating mechanism which is interlocked with the thermal head pressing release mechanism when the operation to release the pressing of the thermal head against the platen is performed, the paper pinch roller is moved away from the paper feed roller while the heat transfer ribbon pinch roller is moved away from the heat transfer ribbon feed roller.

With such an arrangement, when the operation to release the pressing of the thermal head against the platen is performed, the paper pinch roller and the heat transfer ribbon pinch roller of the pinch roller unit are respectively moved away from the paper feed roller and the heat transfer ribbon feed roller so that the heat transfer ribbon can be detachable by mere one operation.

Furthermore, there may be provided first bearings for supporting both ends of the shaft of the paper pinch roller are provided so as to be slidably movable toward or away from the paper feed roller, second bearings for supporting both ends of the shaft of the heat transfer ribbon pinch roller so as to be slidably movable toward or away from the heat transfer ribbon feed roller, a first pressing means for pressing the bearings against and urging the bearings toward the paper feed roller and a second pressing means independent of the first pressing means for pressing the bearing against and urging the bearing toward the heat transfer ribbon feed roller.

With such an arrangement, if the paper pinch roller is brought into contact with the paper feed roller and the heat transfer ribbon pinch roller is brought into contact with the heat transfer ribbon feed roller even if the parts of the thermal printer varies in the accuracy thereof, the bearings for supporting both ends of the shafts of the paper pinch roller and the heat transfer ribbon pinch roller are pressed against and urged toward the paper feed roller and the heat transfer ribbon feed roller by pressing means which are independent of each other so as to be slidable toward the paper feed roller and the heat transfer ribbon feed roller so that the axial line of the paper pinch roller is parallel with the paper feed roller and the heat transfer ribbon pinch roller is parallel with the heat transfer ribbon feed roller. Accordingly, the heat transfer ribbon and the paper are respectively held by each roller in any position of the width direction thereof with uniform pressing force.

The above and other objects, features and advantages of the invention will be apparent from the following detailed description which is to be read in conjunction with the accompanying drawings.

DETAILED DESCRIPTION OF THE PREFERRED EMBODIMENT

A thermal printer according to a preferred embodiment of the present invention will be described with reference to the drawings.

Figure 1:
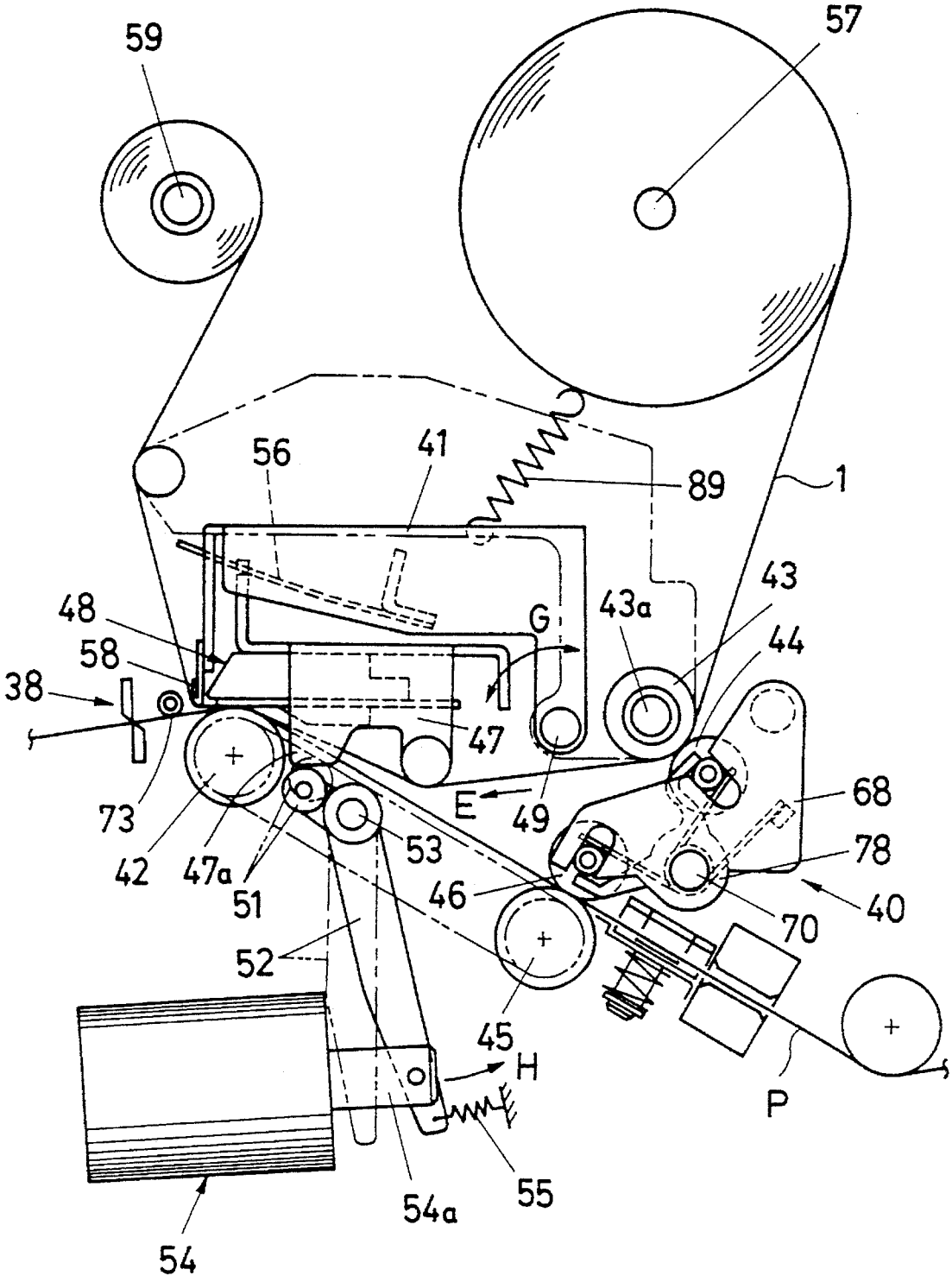
FIG. 1 is a schematic view showing the arrangement of a thermal printer according to a preferred embodiment of the present invention.

The thermal printer as illustrated in FIG. 1 includes a heat transfer ribbon feeding means for feeding a heat transfer ribbon 1 in a normal direction as denoted at E or in a reverse direction opposite to the normal direction and comprises a heat transfer ribbon feed roller 43, a heat transfer ribbon pinch roller 44 and a platen 42, etc.

The heat transfer ribbon 1 which is fed to the normal direction E by the heat transfer ribbon feeding means and a paper P to be printed are allowed to pass between the platen 42 and a thermal head 48 which is pressed against the platen 42 while they are laid on top of another wherein ink impregnated in the heat transfer ribbon 1 is molten by the thermal head 48 to perform the printing on the paper P.

The heat transfer ribbon feed roller 43 and the heat transfer ribbon pinch roller 44 can hold the heat transfer ribbon 1 therebetween and can feed the heat transfer ribbon 1 in the direction opposite the normal direction E independently of the normal direction E.

There are provided on a feeding route of the paper P a paper feed roller 45 and a paper pinch roller 46 for holding the paper P therebetween and feeding the paper P toward and between the platen 42 and the thermal head 48 so as to be held thereby. The paper pinch roller 46 and the heat transfer ribbon pinch roller 44 are integrated with each other to form a pinch roller unit 40 which is detachably attached to a thermal printer body wherein the paper pinch roller 46 can be positioned so as to feed the paper P while the heat transfer ribbon pinch roller 44 can be positioned so as to feed the heat transfer ribbon 1 when the pinch roller unit 40 is mounted on the thermal printer body.

The thermal head 48 is fixed to a head fixed plate 47 by a screw and the head fixed plate 47 is freely attached to a head frame 41 by a holding mechanism such as a spring, etc. so as to swing in all directions in a given scope. The head frame 41 is supported by a supporting shaft 49 at the right lower end portion in FIG. 1 so as to be swung in the direction as denoted at the arrow G.

A protrusion 47*a* is formed on the head fixed plate 47 at the portion close to the platen 42 and a head-up roller 51 is disposed under the lower end edge of the protrusion 47*a* so as to rotatably contact the lower end edge of the protrusion 47*a*. The head-up roller 51 is rotatably attached to one end of a head-up arm 52 which is swingably supported by an arm supporting shaft 53.

The other end of the head-up arm 52 is swingably attached to the plunger 54*a* of a solenoid 54 wherein when the solenoid 54 is turned off, namely, not operated, the head-up arm 52 is swingably urged by the resiliency of a spring 55 in the direction as denoted at the arrow H and is positioned to a solid line in FIG. 1. At this time, the head-up roller 51 is moved away at the upper end thereof from the lower end edge of the protrusion 47*a* of the head fixed plate 47 while the thermal head 48 is brought into contact with the platen 42 when the thermal head 48 is pressed by a pressure plate spring 56 downward by way of the head fixed plate 47.

When the solenoid 54 is operated, the head-up arm 52 is swingably urged in the direction opposite to the arrow H against the resiliency of the spring 55 so that it swings to reach the position as illustrated in the imaginary line so that the head-up arm 51 pushes up the lower end edge of the protrusion 47*a* of the head fixed plate 47. As a result, the thermal head 48 is pushed up together with the head fixed plate 47 from the position as illustrated in FIG. 1 so that the thermal head 48 is moved away from the platen 42.

The heat transfer ribbon 1 is attached to the ribbon supply shaft 57 while it is wound in a roll shape beforehand and is unwound from the ribbon supply shaft 57 at the end thereof and is allowed to pass between the heat transfer ribbon feed roller 43 and the heat transfer ribbon pinch roller 44 and successively is allowed to pass between the thermal head 48 and the platen 42. Successively the heat transfer ribbon 1 is wound around a ribbon winding shaft 59 by way of a separating plate 58 which is integrated with the head frame 41 at the tip end thereof and protrudes downward.

The feeding of the heat transfer ribbon 1 together with the paper P while they are laid on top of another in the normal direction E is carried out simultaneously by the platen 42 which is brought into contact with the thermal head 48 as illustrated in FIG. 1 whereby the heat transfer ribbon 1 is wound by the ribbon winding shaft 59 by the length corresponding to the length extending from the printing portion by the thermal head 48 to the outlet thereof.

A driving system for feeding the heat transfer ribbon 1 will be described with reference to FIG. 2.

The ribbon winding shaft 59 is driven as follows. The driving power from a ribbon motor 61 is transmitted to a motor gear 62 which is fixed to the rotary shaft of the ribbon motor 61, an idle gear 63 which engages with the motor gear 62, a winding torque limiter 64 to which the turning effort of the idle gear 63 is transmitted and to a ribbon winding gear 65 which is integrated with the ribbon winding shaft 59 to which the turning effort of the winding torque limiter 64 is transmitted.

A one way clutch 66 is mounted between the ribbon winding shaft 59 and the ribbon winding gear 65 wherein the turning effort of the ribbon winding gear 65 is transmitted to the ribbon winding shaft 59 in the winding direction as denoted at the arrow J by way of the one way clutch 66 while the same turning effort is not transmitted in the ribbon unwinding direction opposite to the ribbon winding direction J.

The amount of winding of the heat transfer ribbon 1 by the ribbon winding shaft 59 is set to be greater than the amount of feeding of the ribbon by the rotation of the platen 42 but the torque of the winding torque limiter 64 is set to be less than the feeding force by the platen 42 wherein the winding torque limiter 64 slips and idles when the heat transfer ribbon 1 is fed in the normal direction so that the heat transfer ribbon 1 is always wound by the ribbon winding shaft 59 without generating the slack thereon between the printed portion of the thermal head 48 and the ribbon winding shaft 59.

Figure 2:
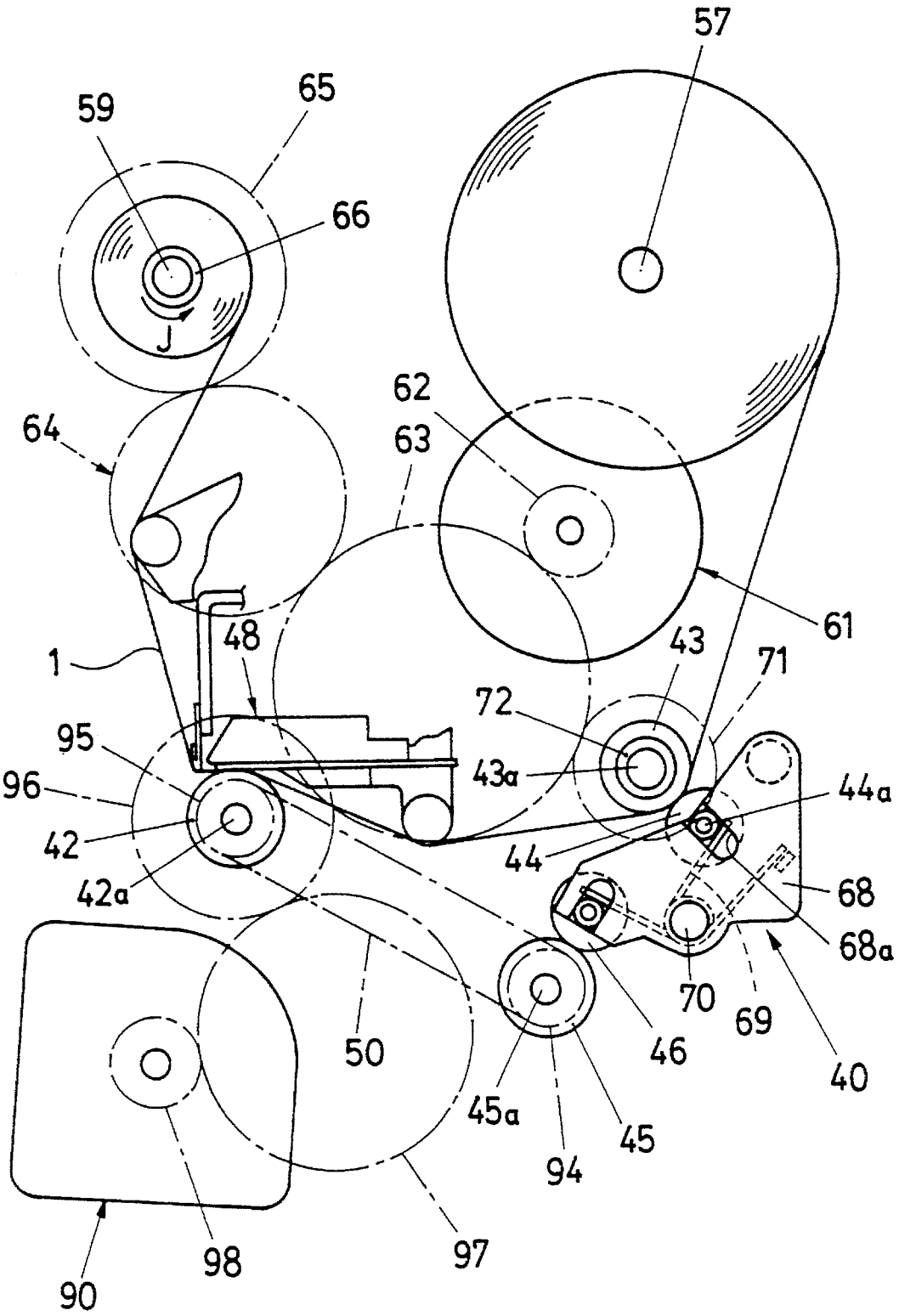
FIG. 2 is a schematic view showing the arrangement of a driving system of the thermal printer of FIG. 1.

The heat transfer ribbon feed roller 43 is disposed at the right side of the thermal head 48 in FIG. 2 and the heat transfer ribbon pinch roller 44 of the pinch roller unit 40 which faces the heat transfer feed roller 43 has a shaft 44*a* both ends of which are movable in notches 68*a* and 68*a* formed in side plates 68 and 68'(refer to FIG. 3 since they do not appear in FIG. 2) by way of bearings.

Figure 3:
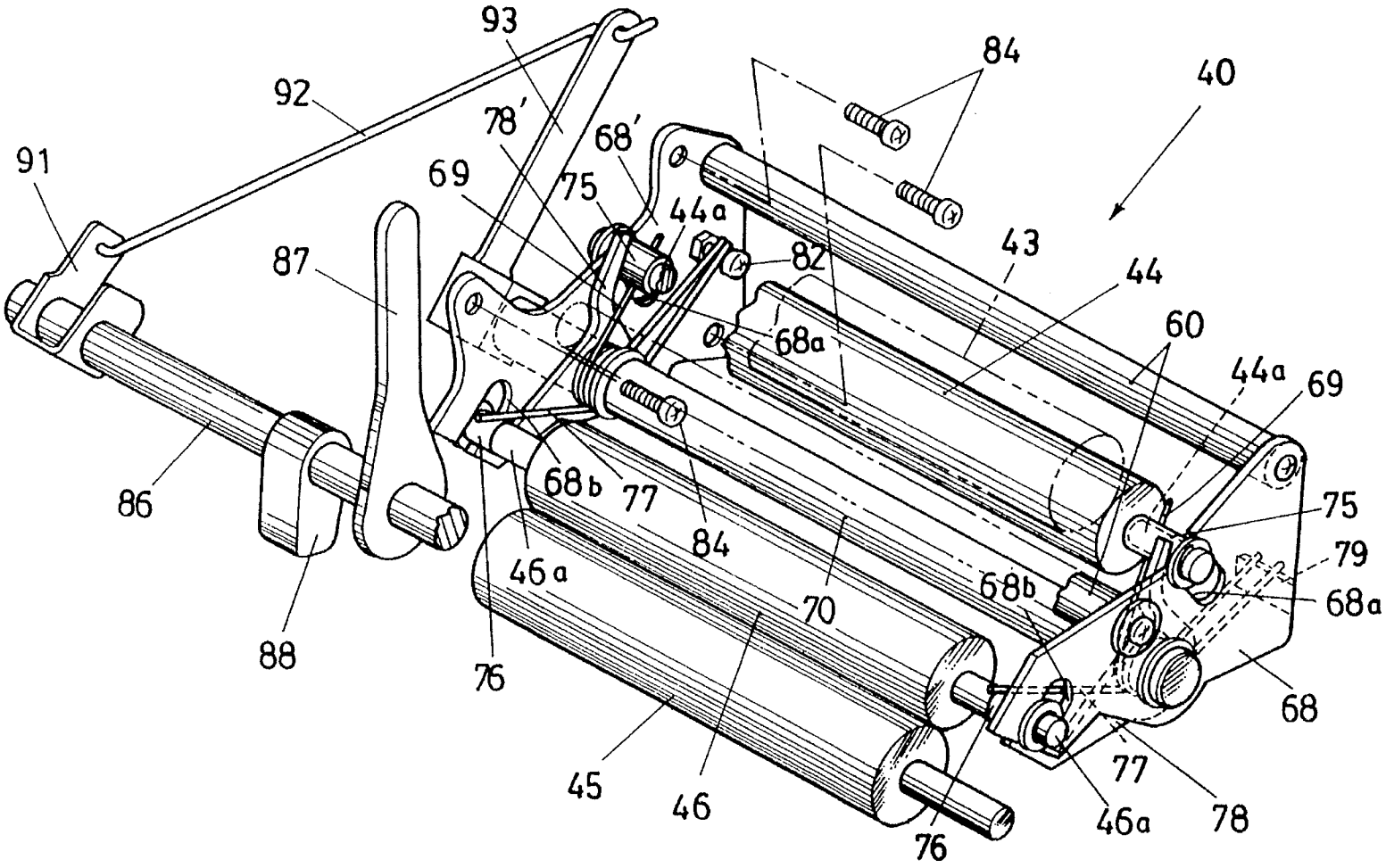
FIG. 3 is an enlarged perspective view showing a pinch roller unit of FIG. 1.

In the state where the pinch roller unit 40 is mounted on the thermal printer as illustrated in FIG. 3 wherein the springs 69 and 69 press against each bearing at one ends thereof and press against each stopper at the other ends thereof and the heat transfer ribbon pinch roller 44 is brought into contact with the heat transfer ribbon feed roller 43 uniformly at a given pressing force adapted for feeding the heat transfer ribbon 1 and at any position in the entire axial direction while the shafts of the heat transfer ribbon pinch roller 44 and the heat transfer ribbon feed roller 43 are parallel with each other.

The heat transfer ribbon feed roller 43 has a shaft 43*a* which is rotatably driven by a roller gear 71 meshing with the idle gear 63. A one way clutch 72 is provided between the shaft 43*a* of the heat transfer ribbon feed roller 43 and the roller gear 71 and it is free in the direction as denoted at the arrow E for feeding the heat transfer ribbon 1 and functions to transmit the turning effort of the roller gear 71 to the shaft 43*a* of the heat transfer ribbon feed roller 43 in the direction opposite to the direction of the arrow E.

Figure 15:
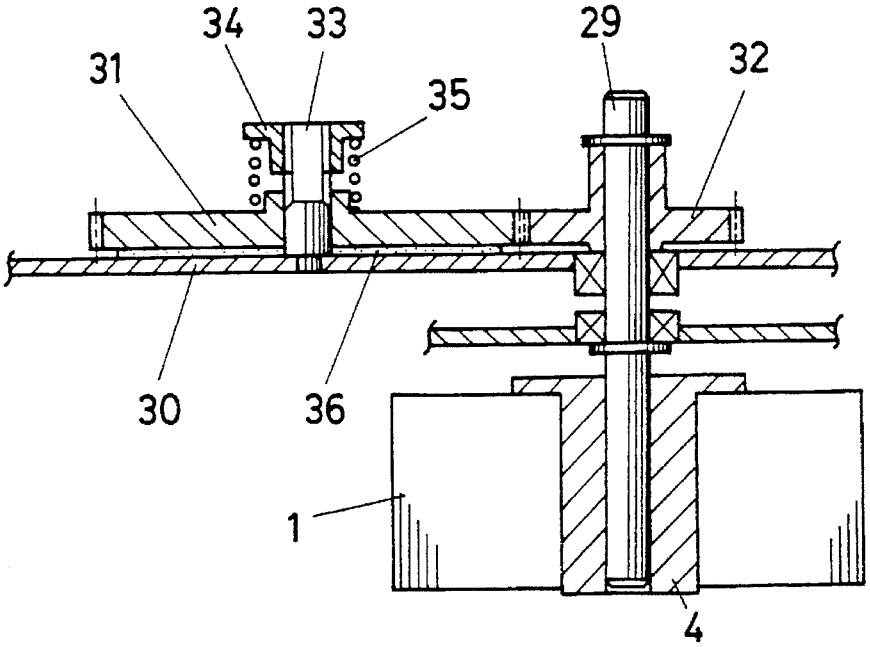
FIG. 15 is a view showing a detailed mechanism for applying tension to the heat transfer ribbon of FIG. 14.

A given frictional load is applied to the ribbon supply shaft 57 for feeding the heat transfer ribbon 1 by the mechanism as explained in FIG. 15 for preventing the heat transfer ribbon 1 from generating wrinkle thereon between the printing position by the thermal head 48 and the ribbon supply shaft 57.

The paper feed roller 45 for feeding the paper P has a diameter which is the same as the outer diameter of the platen 42. A timing pulley 94 is fixed to the other side end of the shaft 45*a* of the paper feed roller 45. A timing pulley 95 is fixed to the other side end of the shaft 42*a* of the platen 42 and has the same number of teeth as the timing pulley 94. A timing belt 50 is extended between the timing pulleys 94 and 95 so that the paper feed roller 45 can rotate in the same direction and at the same speed as the platen 42 in synchronism with the platen 42.

A platen gear 96 is integrally fixed to the shaft 42*a* of the platen 42 and meshes with a motor gear 98 fixed to a rotary shaft of a platen motor 90 by way of an idle gear 97. Accordingly, when the platen motor rotates, the platen 42 and the paper feed roller 45 rotate at the same time.

Meanwhile, according to the embodiment, if there appears a large blank space between the printed portions on the paper, the heat transfer ribbon 1 remains fed in the normal direction after the printing is performed on the paper while the heat transfer ribbon is laid on top of the paper P and thereafter the heat transfer ribbon 1 is separated from the paper P in order to prevent the heat transfer ribbon 1 is wastefully consumed. Thereafter the thermal head 48 is pushed upward from the platen 42 while the paper P is fed leftward in FIG. 1 by the length corresponding to the blank space on the paper P. At the same time, the heat transfer ribbon 1 is returned to the direction opposite to the normal direction by the length corresponding to the distance extending from the printing position to the position where the heat transfer ribbon 1 is separated from the paper P so as to prepare for the next printing, whereby the ribbon saving operation can be performed to use the heat transfer ribbon effectively.

In order to prevent the paper P from being rubbed against the heat transfer ribbon 1, there is provided a paper pressing roller 73 downstream the thermal head 48 in the paper feeding route as illustrated in FIG. 1.

The paper pressing roller 73 is formed of a material such as polyacetal on which ink impregnated in the heat transfer ribbon 1 is difficult to be transferred and has a cylindrical shape. A shaft is inserted into the paper pressing roller 73 and both ends of the shaft is fixed so that the paper pressing roller 73 can rotate. With such an arrangement, ink transferred onto the paper P by in the heat transfer ribbon 1 is prevented from sticking to the paper pressing roller 73 so the paper pressing roller 73 can press the paper the paper P without contaminating the paper P by ink.

The pinch roller unit 40 is described in detail with reference to FIGS. 3 and 4.

The pinch roller unit 40 comprises the unit side plates 68 and 68', the paper pinch roller 46 and the heat transfer ribbon pinch roller 44 wherein the paper pinch roller 46 and the heat transfer ribbon pinch roller 44 which are respectively incorporated between the unit side plates 68 and 68'.

Bearings 75 and 75 respectively supporting both ends of the shaft 44*a* of the heat transfer ribbon pinch roller 44 respectively slidably engage in notches 68*a* and 68*a* formed in the unit side plates 68 and 68' in the direction to move toward or away from the heat transfer ribbon feed roller 43.

Likewise, bearings 76 and 76 respectively supporting both ends of the shaft 46*a* of the paper pinch roller 46 respectively slidably engage in notches 68*b* and 68*b* formed in the unit side plates 68 and 68'in the direction to move toward or away from the heat transfer ribbon feed roller 45.

Both ends of the shaft 44*a* of the heat transfer ribbon pinch roller 44 are respectively pressed and urged by springs 69 and 69 in the direction to approach the heat transfer ribbon feed roller 43. Likewise, both ends of the shaft 46*a* of the paper pinch roller 46 are respectively pressed and urged in the direction to approach the paper feed roller 45 by one ends of springs 77 and 77 by way of bearings 76 and 76 for supporting both ends the shaft 46*a* independently of each other. The other ends of the springs 77 and 77 are brought into contact with a stopper 79 and an adjusting screw 82.

The unit side plates 68 and 68' of the pinch roller unit 40 are connected to each other by fixed shafts 60 and 60 and a release arm rotary shaft 70, which is disposed in parallel with the heat transfer ribbon pinch roller 44 and the paper pinch roller 46, rotatably engages in the unit side plates 68 and 68' at the portion adjacent to both ends thereof. Pinch roller release arms 78 and 78' having the same shapes are fixed integrally to both ends of the release arm rotary shaft 70 so as to be positioned inside the unit side plates 68 and 68'.

Figure 4:
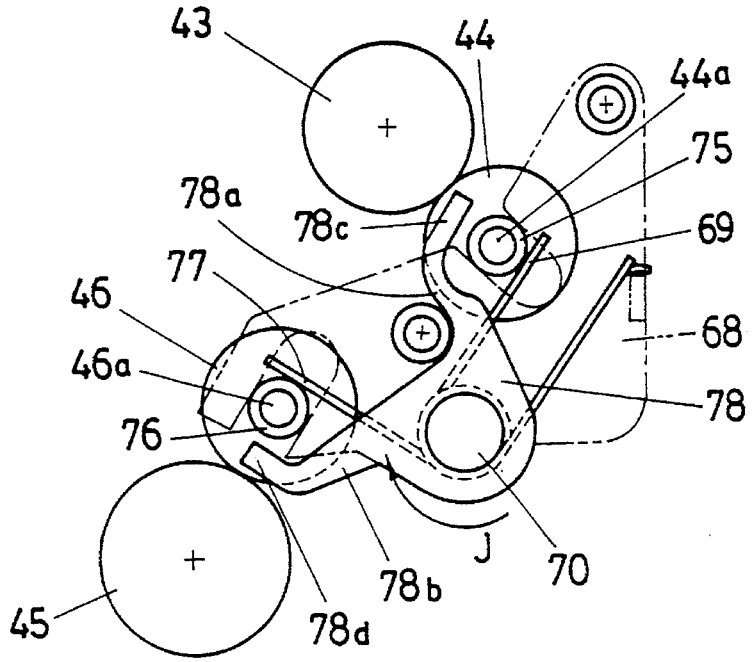
FIG. 4 is a front view showing the pinch roller unit which is positioned where a paper and a heat transfer ribbon are respectively mounted thereon so as to be fed.

The pinch roller release arm 78 has arms 78*a* and 78*b* which extend to two directions from the fixed portion of the release arm rotary shaft 70 as illustrated in FIG. 4 wherein the arm 78*a* has a hook 78*c* capable of bringing into contact with a bearing 75 for supporting both ends of the shaft 44*a* of the heat transfer ribbon pinch roller 44 at the tip end thereof while the arm 78*b* has a hook 78*d* capable of bringing into contact with a bearing 76 for supporting both ends of the shaft 46*a* of the paper pinch roller 46 at the tip end thereof.

Figure 5:
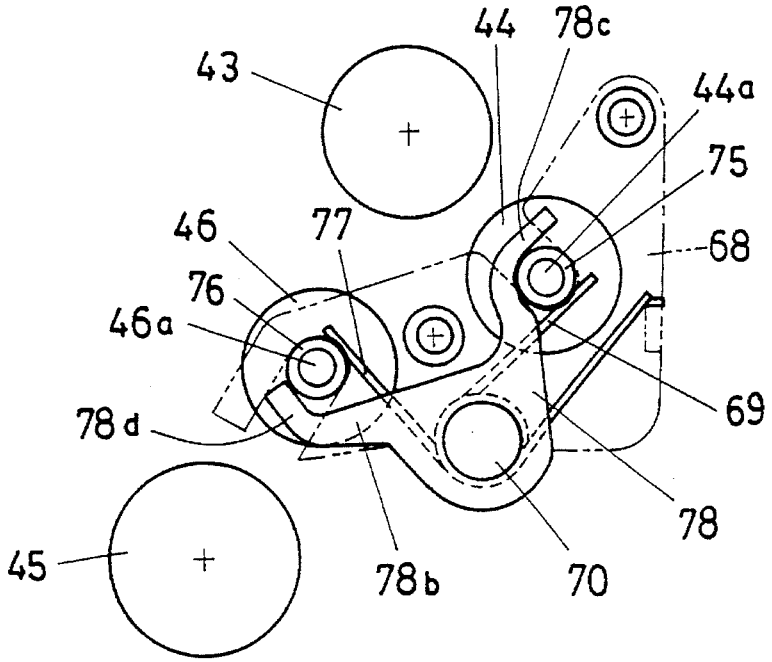
FIG. 5 is a front view showing the pinch roller unit which is shifted to the position where the paper and the heat transfer ribbon are respectively mounted.

When the release arm rotary shaft 70 is rotated in the direction denoted at the arrow J in FIG. 4, the pinch roller release arms 78 and 78' which are integrated with the release arm rotary shaft 70 (FIG. 3) are rotated at the same time whereby the hook 78*c* of the arm 78*a* moves the heat transfer ribbon pinch roller 44 to the position as illustrated in FIG. 5 by way of the bearings 75 while the hook 78*d* of the arm 78*b* moves the paper pinch roller 46 to the position as illustrated in FIG. 5 by way of the bearings 76. As a result, the heat transfer ribbon pinch roller 44 is moved away from the heat transfer ribbon feed roller 43 while the paper pinch roller 46 is moved away from the paper feed roller 45.

Meanwhile, both ends of the shaft of the heat transfer ribbon feed roller 43 facing the heat transfer ribbon pinch roller 44 and both ends of the shaft of the paper feed roller 45 facing the paper pinch roller 46 are respectively rotatably supported by beatings, not shown, which are fixed to the fixed portion of the thermal printer body.

At the state where the pinch roller unit 40 is not mounted on the thermal printer body and the release arm rotary shaft 70 is not rotated in the direction of the arrow J, the heat transfer ribbon pinch roller 44, which is movable at the both ends of the shaft 44*a* along the recesses 68*a* of the unit side plates 68 and 68', is pressed against the heat transfer ribbon feed roller 43 having the shaft fixed to the thermal printer body by the resiliency of the springs 69 and 69. Likewise, the paper pinch roller 46, which is movable at the both ends of the shaft 46*a* along the recesses 68*b* of the unit side plates 68 and 68', is pressed against the paper feed roller 45 having the shaft fixed to the thermal printer body by the resiliency of the springs 77 and 77.

Accordingly, even if the axial line of the heat transfer ribbon feed roller 43 is not parallel with that of the heat transfer ribbon pinch roller 44 or the axial line of the paper feed roller 45 is not parallel with that of the paper pinch roller 46 because of the variation of the accuracy of the parts or the accuracy of the assembly of the thermal printer, the heat transfer ribbon feed roller 43 becomes parallel with the heat transfer ribbon pinch roller 44 because the latter is pressed against the former and the paper feed roller 45 becomes parallel with the paper pinch roller 46 because the latter is pressed against the former. Accordingly, the heat transfer ribbon 1 and the paper P are respectively held by each roller at any position (each position in the width directions thereof) of the axial direction thereof with uniform pressing force.

The thermal printer has a unit inclination adjusting mechanism capable of inclining the entire pinch roller unit 40 by the inclination angle q whereby the advancing direction of the paper is inclined by the inclination angle q relative to a feeding standard line Lba which is parallel with a paper end standard surface 85*a* which is integrated with a frame 83 of the thermal printer body.

The unit inclination angle adjusting mechanism comprises the adjusting screw 82 which is screwed into a screw hole 81 formed in the rear end side (upper side in FIG. 6) of the unit side plate 68' which supports the other side shaft 44*a* of the heat transfer ribbon pinch roller 44 and the shaft 46*a* of the paper pinch roller 46 by way of bearings, not shown, a fixed nut 80 which fixes the adjusting screw 82 at the state where the adjusting screw 82 is screwed until it projects from the left end surface of the frame 83 of the unit side plate 68' and three fixed screws 84 (also refer to F1G. 3) for fixing the unit side plate 68' to the frame 83. Accordingly, the inclination angle q of the pinch roller unit 40 can be arbitrarily adjusted by adjusting the amount of projection of the adjusting screw 82 from the left end surface of the unit side plate 68'.

Supposing that the inclination angle q set to be q>0, the pinch roller unit 40 is inclined by the inclination angle q so that an axial line $L_1$ of the paper pinch roller 46 is inclined by the inclination angle q relative to the axial line of the paper feed roller 45 (FIG. 3).

Figure 6:
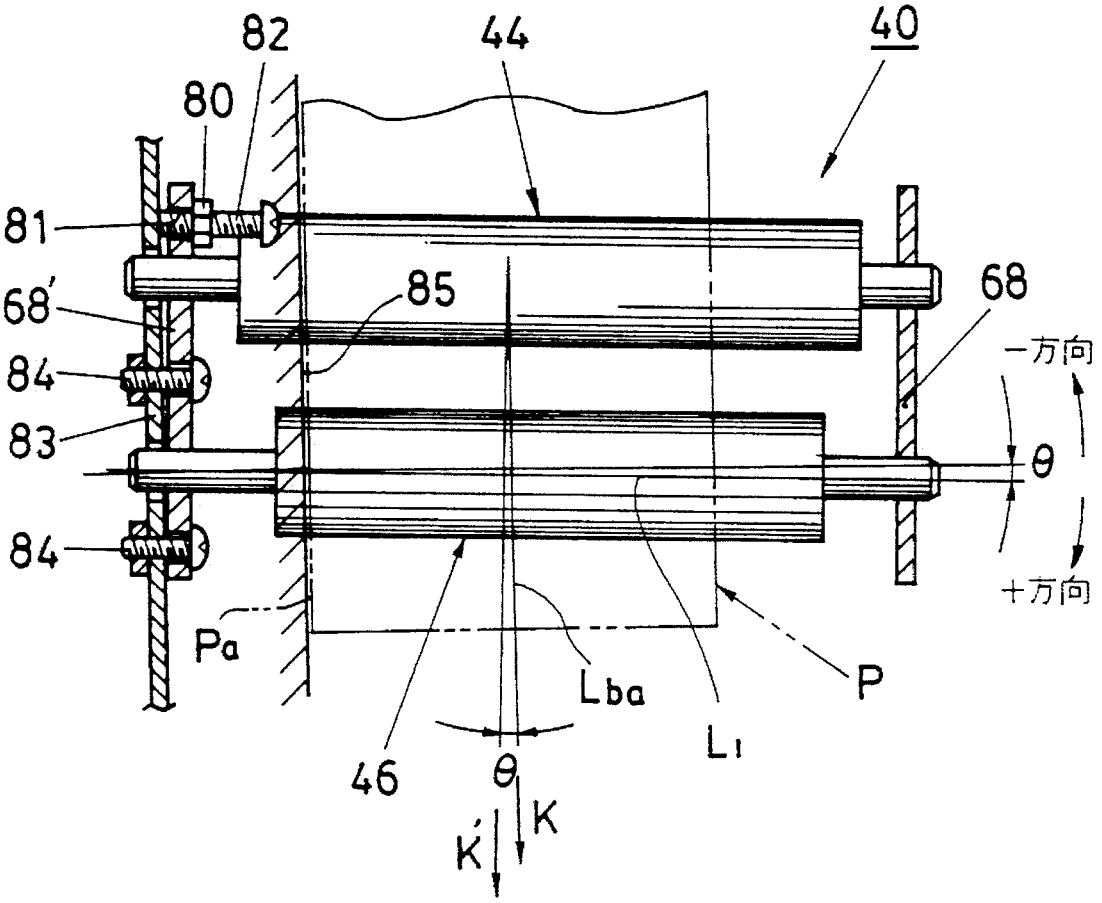
FIG. 6 is a plan view explaining a unit inclination angle adjusting mechanism for inclining the pinch roller unit of FIG. 3.

Accordingly, the paper P which is guided on the paper feeding route by the paper feed roller 45 and the paper pinch roller 46 is guided in the direction of the advancing direction (the arrow denoted at K') which is inclined by the inclination angle q relative to the paper feeding direction (the arrow denoted at K) in case that the inclination angle q is equal to 0 so that the paper P is fed in the direction of the arrow K while the paper P is pressed by the paper end standard surface 85 at the side edge Pa thereof as illustrated in the left side of FIG. 6. As a result, the skew of the paper P is corrected so that the paper P can be fed along the paper end standard surface 85 with high accuracy.

On the other hand, if the inclination angle q is too large, the side edge of the paper is strongly pressed against the paper end standard surface 85 in case that the paper is thin so that the end edge is liable to be damaged. In such a case, the thin paper is first fed, then the amount of screwing of the adjusting screw 82 is adjusted confirming the degree of the pressing of the end edge Pa thereof relative to the paper end standard surface 85 and finally the unit side plate 68'is fixed to the frame 83 by three fixed screws 84 at the position where the paper P can be fed to the extent that the end edge Pa of the paper P is neither bent nor damaged.

With such an arrangement, even if the paper P is of a different kind such as a thin paper, the paper P can be fed while it is neither damaged nor skews to thereby perform the excellent printing by regulating the inclination angle f to an optimum angle.

A thermal head pressing release mechanism for moving the thermal head away from the platen and a pinch roller separating mechanism which interlocks with the thermal head pressing release mechanism are described hereinafter.

Figure 7A:
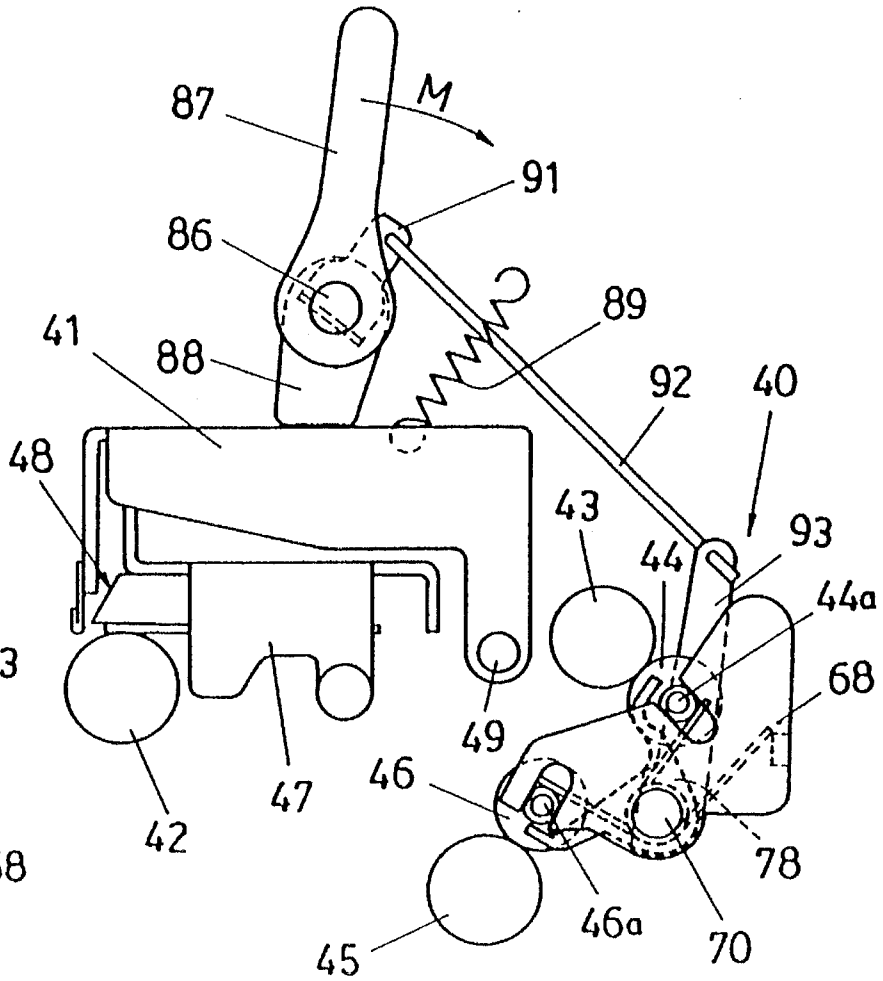
FIG. 7(*a*) is a schematic view showing the state where a thermal head pressing release mechanism is positioned not to release the printings of the thermal head against a platen and FIG. 7(*b*) is a schematic view showing the state where the thermal head pressing release mechanism is positioned to release the pressing of the thermal head against the platen.
Figure 7B:
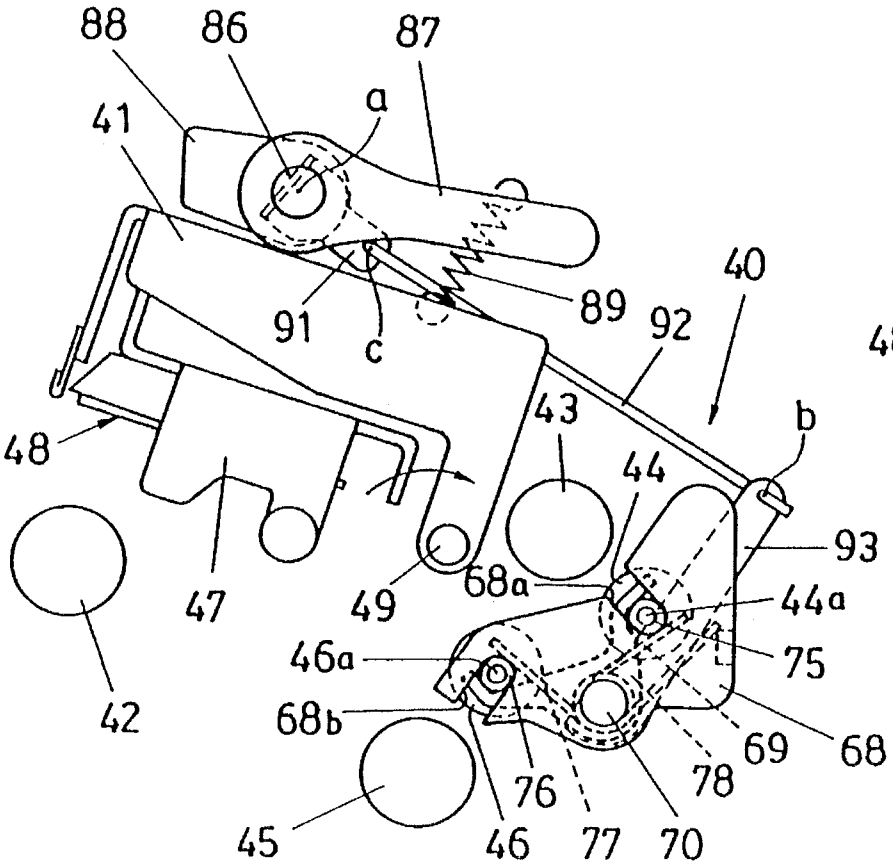

The thermal printer has the thermal head pressing release mechanism for releasing the pressing of the thermal head 48 against the platen 42 and the pinch roller separating mechanism which interlocks with the thermal head 48 when the releasing operation of the pressing of the thermal head 48 against the paper pinch roller 46 of the pinch roller unit 40 away from the paper feed roller 45 while moving the heat transfer ribbon pinch roller 44 away from the heat transfer ribbon feed roller 43 as illustrated in FIGS. 7(*a*) and 7(*b*).

The thermal head pressing release mechanism comprises a head push-down shaft 86, which is turnably supported by the fixed portion of the thermal printer body, a head push-down lever 87 an end of which is fixed to the head push-down shaft 86 at the portion adjacent to the central portion in the longitudinal direction of the head push-down shaft 86 and a push-down cam 88 which is integrally fixed to the head push-down shaft 86 wherein the head push-down shaft 86 and the push-down cam 88 are turned in the same direction when the head push-down lever 87 is turned in the direction as denoted at the arrow M from the state where the paper P and the heat transfer ribbon can be fed. At that time, the head frame 41 which holds the thermal head 48 and has been pressed by the push-down cam 88 is turned about the supporting shaft 49 by the urging force of a coil spring 89 as illustrated in FIG. 7(*b*). As a result, the thermal head 48 is moved away from the platen 42 so that the pressing of the thermal head 48 against the platen 42 is released.

The pinch roller separating mechanism comprises an interlocking lever 91 integrally fixed to the other end of the head push-down shaft 86, a connecting rod 92 having one end which is rotatably attached to the tip end of the interlocking lever 91 and a turning lever 93 having the other end connected to the other end of the connecting rod 92 and one end connected to the release arm rotary shaft 70.

When the head push-down lever 87 is turned from the position as illustrated in FIG. 7(*a*) to the position as illustrated in FIG. 7(*b*), the interlocking lever 91 is also turned in association with the turning of the push-down lever 87. At this time, since the interlocking lever 91 is connected to the turning lever 93 by way of the connecting rod 92, the turning lever 93 is turned to the position as illustrated in FIG. 7(*b*) as the interlocking lever 91 is turned.

The turning lever 93 is integrated with the pinch roller release arms 78 and 78' by way of the release arm rotary shaft 70 as illustrated in FIG. 3, the pinch roller release arms 78 and 78' are turned clockwise when the turning lever 93 is turned. As a result, the bearings 75 and 75 for supporting both ends of the shaft 44*a* of the heat transfer ribbon pinch roller 44 are respectively moved away from the heat transfer ribbon feed roller 43 in the recesses 68*a* and 68*a* of the unit side plates 68 and 68'.

At the same time, the bearings 76 and 76 for supporting both ends of the shaft 46*a* of the paper pinch roller 46 are respectively moved away from the paper feed roller 45 in the recesses 68*b* and 68*b* of the unit side plates 68 and 68' as illustrated in FIG. 7(*b*).

Meanwhile, when the heat transfer ribbon pinch roller 44 and the paper pinch roller 46 are moved to the position as illustrated in FIG. 7(*b*), the force is applied to the pinch roller release arms 78 and 78' so as to return the pinch roller release arms 78 and 78' to the position as illustrated in FIG. 7(*a*) by the repelling force of the springs 69 and 77. The force applied to the pinch roller release arms 78 and 78' is transmitted to the release arm rotary shaft 70, the turning lever 93 and the connecting rod 92 in this order and finally to the interlocking lever 91 at the tip end portion thereof.

However, when the interlocking lever 91 is turned to the position as illustrated in FIG. 7(*b*) according to this embodiment, the turning center c along which the connecting point between interlocking lever 91 and the connecting rod 92 draws a circle is positioned under the straight line connecting the turning center a about which the interlocking lever 91 is turned and the turning center b about which the connecting rod 92 is turned at the turning lever 93 wherein the spring 69 on the release arm rotary shaft 70 is brought into contact with the stopper, not shown, so that the interlocking lever 91 is positioned. Accordingly, the pinch roller release arms 78 and 78' (FIG. 3) which are moved to the position as illustrated in FIG. 7(*b*) are not likely to be returned by the repelling force of the springs 69 and 77.

When the thermal head pressing release mechanism for releasing the pressing of the thermal head 48 against the platen 42 is operated, the pinch roller separating mechanism is interlocked with the thermal head pressing release mechanism so that the paper pinch roller 46 of the pinch roller unit 40 is moved away from the paper feed roller 45 while the heat transfer ribbon pinch roller 44 is moved away from the heat transfer ribbon feed roller 43.

Accordingly, if one operation for releasing the pressing of the thermal head 48 against the platen 42 is performed, the paper pinch roller 46 of the pinch roller unit 40 is moved away from the paper feed roller 45 while the heat transfer ribbon pinch roller 44 is moved away from the heat transfer ribbon feed roller 43, which facilitating the detachment of the paper P and the heat transfer ribbon 1 and also improving the operability.

When the paper P is set on the thermal printer, it is inserted between the paper pinch roller 46 and the paper feed roller 45 from the front side to the innermost side in FIG. 7(*b*) and thereafter it is inserted between the thermal head 48 and the platen 42. When the heat transfer ribbon 1 is set on the thermal printer, it is inserted between heat transfer ribbon pinch roller 44 and the heat transfer ribbon feed roller 43 while it is mounted on a ribbon setting jig, not shown, from the front side to the innermost side in FIG. 7(*b*) and thereafter it is inserted between the thermal head 48 and the platen 42.

A ribbon save mechanism provided in the thermal printer is described hereinafter.

In the thermal printer having the thermal head, the thermal head is pressed against the platen in a given pressing force and the heat transfer ribbon 1 and the paper P are allowed to pass between the thermal head and the platen wherein ink impregnated in the heat transfer ribbon 1 is molten by thermal energy of the heating element 48*a* of the thermal head 48 and transferred onto the paper P to thereby perform the printing.

Since the printing is performed when the heat transfer ribbon 1 and the paper P are pressed by the thermal head against the platen while they are laid on top of another, they are fed at the same time during the printing operation.

Figure 8:
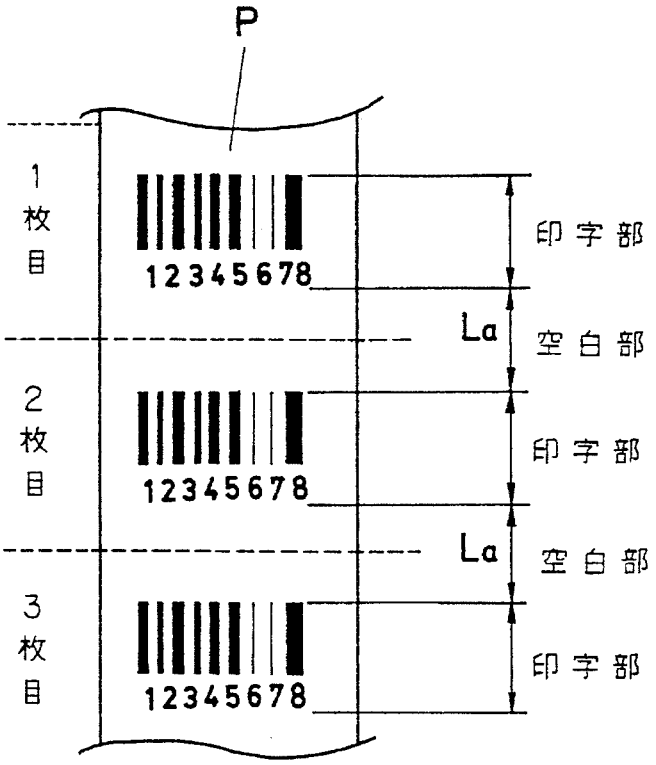
FIG. 8 is a plan view showing large space blanks between printed portions on the paper.

Accordingly, if there appears a large blank space between printed portions on the paper P as illustrated in FIG. 8, the heat transfer ribbon 1 and the paper P are allowed to pass between the thermal head and the platen while the large blank space is not subjected to the printing so that the portion on the heat transfer ribbon 1 ink impregnated into which is not used for transferring onto the paper P occupies 50% of the heat transfer ribbon 1 depending on the size of the blank space on the paper P, which leads to the waste of the heat transfer ribbon 1.

To avoid the waste of the heat transfer ribbon 1, the ribbon save mechanism is provided in order to effectively use the heat transfer ribbon 1 even if there appears the large blank space between the printed portions on the paper P.

Figure 9:
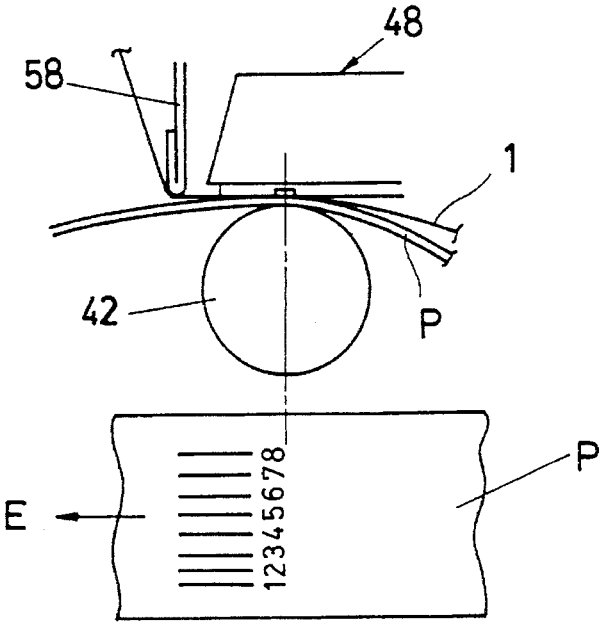
FIG. 9 is front and plan views explaining the relation between the thermal head and the paper upon completion of the printing on the paper.

If there appears the large blank space between the printed portions on the paper P, the heat transfer ribbon 1 and the paper P are allowed to pass between the thermal head 48 and the platen 42 while the heat transfer ribbon 1 is laid on top of the paper P and thereafter a first printing is performed. After the completion of the first printing, both the heat transfer ribbon 1 and the paper P remain fed in the direction of the arrow E as illustrated in FIG. 9.

If the heat transfer ribbon 1 is separated from the paper P after the entire printed portions reach the separating plate 58, the solenoid 54 as illustrated in FIG. 1 is energized to operate to thereby swing the head-up arm 52 to the position as denoted at an imaginary line so as to raise the head-up roller 51 whereby the thermal head 48 is pushed up to move away from the platen 42.

When the thermal head 48 is moved away from the platen 42, the platen 42 can not feed the heat transfer ribbon 1 and the paper P so that the paper P is continuously fed leftward in FIG. 1 by the feeding force of the paper feed roller 45 and the paper pinch roller 46 and thereafter reaches the second printing position where it stops for preparation of the next printing.

Since the paper pinch roller 46 per se has not turning effort, the paper pinch roller 46 presses the paper P against the paper feed roller 45 to feed the paper P and rotates in association with the movement of the paper P.

The feeding amount of the paper P after the completion of the previous printing is the length La of the blank spaces as illustrated in FIG. 8.

While the paper P is fed in the normal direction to reach the second printing position, the heat transfer ribbon 1 is fed reversely, i.e. rightward in FIG. 1. The reverse feeding amount corresponds to the length which is the difference between the length Lb which extends from the separating plate 58 to the heating element 48*a* of the thermal head 48 and the margin Lc between the transferred portions on the heat transfer ribbon 1.

There is another method of saving ribbon by feeding the heat transfer ribbon 1 and the paper P at the same time to the second printing position, pushing up the thermal head 48 from the platen 42 and thereafter feeding the heat transfer ribbon 1 alone reversely by the length of the non-used portion thereon corresponding to the blank space on the paper P.

If the reverse feeding of the heat transfer ribbon 1 is completed, the solenoid 54 is deenergized to be turned off so that the thermal head 48 is returned to the original position so as to press against the platen 42, followed by the preparation of the next printing.

Figure 11:
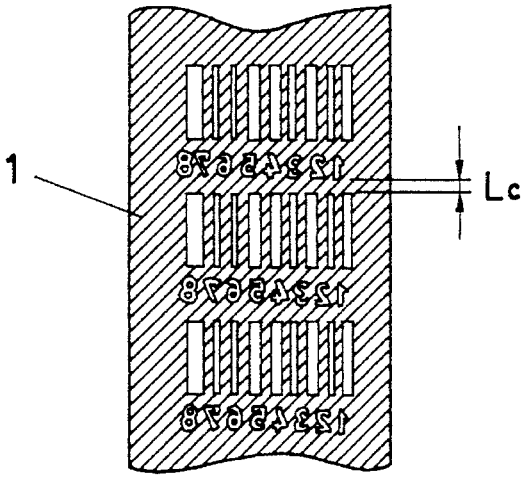
FIG. 11 is a plan view showing that the heat transfer ribbon is effectively used even if there appear large blank spaces between printed portion on the paper.
Figure 12:
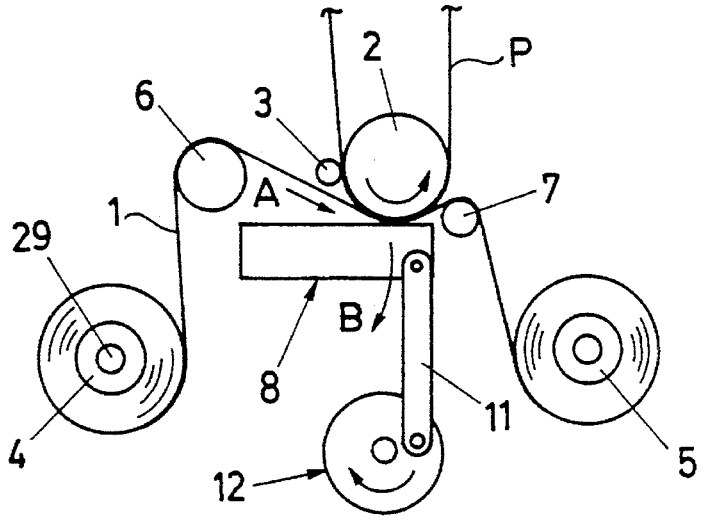
FIG. 12 is a schematic view showing a thermal head and a periphery thereof of a conventional thermal printer.
Figure 13:
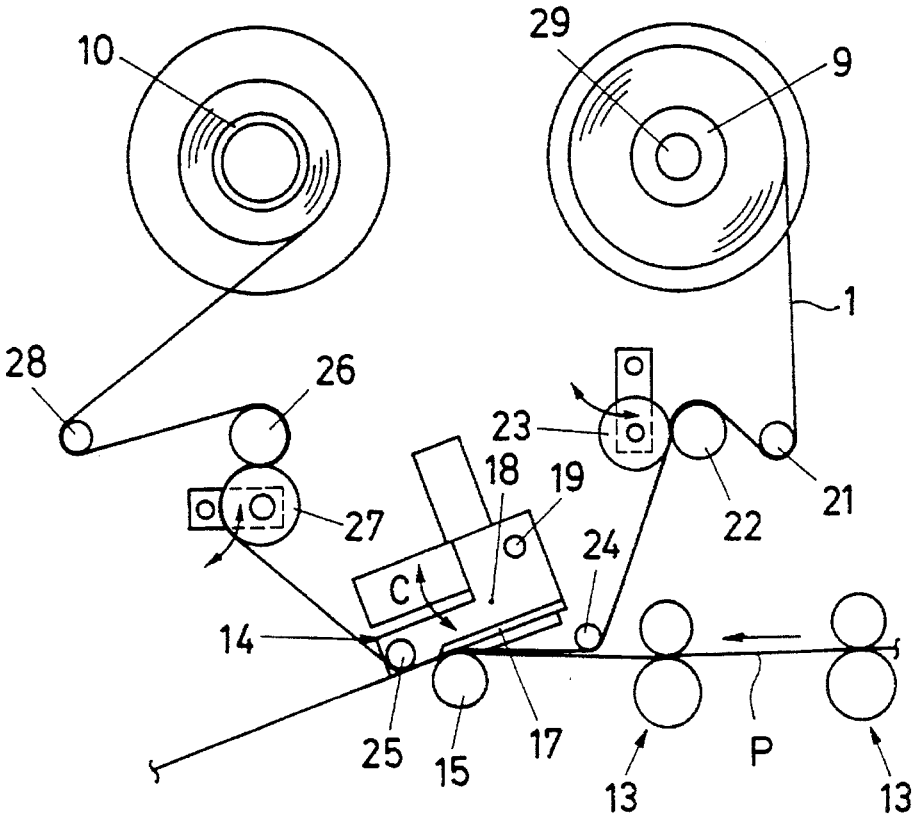
FIG. 13 is a schematic view of the conventional thermal printer showing the state where a pair of rollers hold and feed a heat transfer ribbon.

With such series of operations are repeated, the heat transfer ribbon 1 can be effectively used without leaving the non-used portion, which is not used for transferring ink onto the paper P between the adjacent transferred portions on the heat transfer ribbon 1, but the irreducible minimum as illustrated in FIG. 11.

Inasmuch as the feeding of the paper P is performed independently of the feeding of the heat transfer ribbon 1 using different power sources, it is possible to feed the paper P and the heat transfer ribbon 1 in the different directions by driving the power sources in the different directions at the same time.

Figure 10:
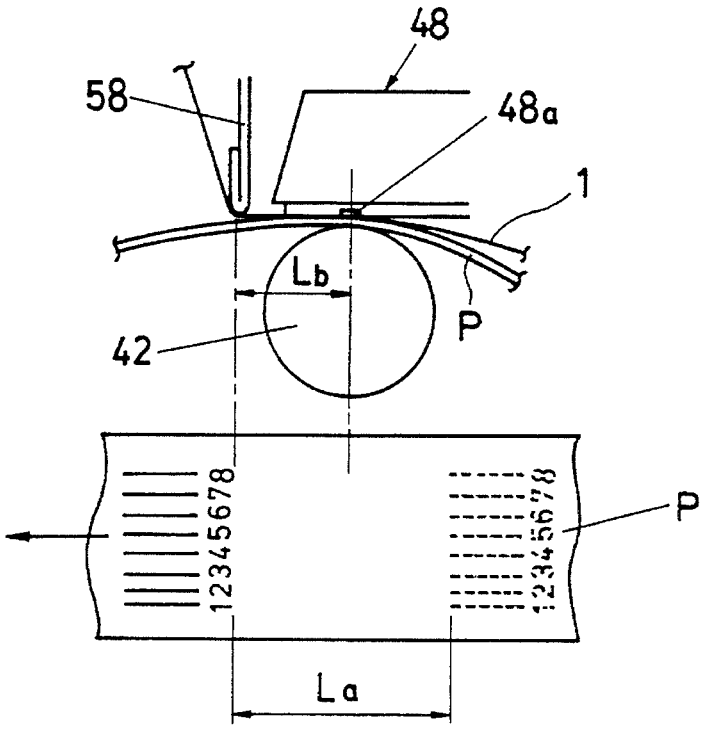
FIG. 10 is front and plan views explaining the relation between the thermal head and the paper when the rear end of the printed portion is fed to a separating plate.

The waste of the heat transfer ribbon 1 can be reduced to the minimum according to the present embodiment as illustrated in FIG. 11 although the heat transfer ribbon 1 is wasted in the conventional thermal printer since there appear non-used portions on the heat transfer ribbon 1 which are not transferred onto the paper P by the length Lb as illustrated in FIG. 10 in the case that the paper P and the heat transfer ribbon 1 are respectively fed by the same driving power where the heat transfer ribbon 1 stops after the printed portions on the paper P reach the separating position after the completion of the first printing and thereafter the paper P alone is continuously fed in the same normal direction so as to perform the next printing.

Since the normal feeding operation of the paper P and the reverse feeding operation of the heat transfer ribbon 1 can be performed at the same time, it is possible to perform a series of ribbon saving operations without reducing the printing speed.

Denoted at dotted lines on the paper P in FIG. 10 are portions to be printed next.

Figure 14:
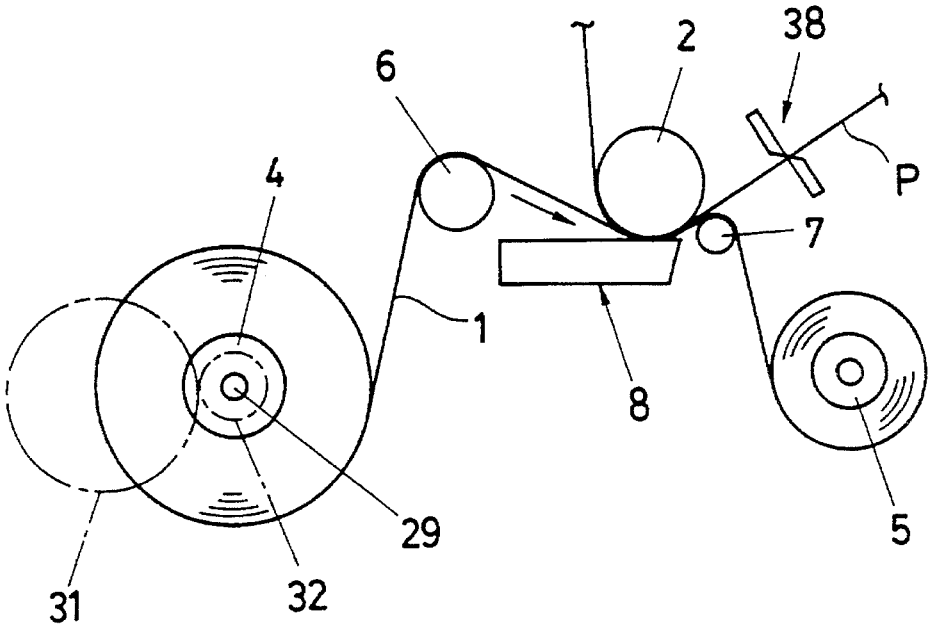
FIG. 14 is a schematic view of a mechanism of the conventional thermal printer for preventing the heat transfer ribbon from generating wrinkle thereon by applying tension thereto.

Since the heat transfer ribbon is prevented from generating wrinkle thereon by applying a given tension to the heat transfer ribbon by giving frictional load to the ribbon supply shaft in the conventional thermal printer as illustrated in FIG. 14, the tension to be applied to the heat transfer ribbon is varied as the outer diameter of the heat transfer ribbon is reduced when the heat transfer ribbon is used so that the heat transfer ribbon is not always stably stretched at a given tension between the supply roller and the thermal head.

However, since the heat transfer ribbon 1 is held between the heat transfer ribbon feed roller 43 and the heat transfer ribbon pinch roller 44 as illustrated in FIG. 1 according to the thermal printer of the present embodiment, if the frictional load is given to the heat transfer ribbon feed roller 43 by the mechanism as illustrated in FIG. 15 to thereby apply the tension to the heat transfer ribbon 1 which is extended between the thermal head 48 and the heat transfer ribbon feed roller 43 so that the tension to be applied to the heat transfer ribbon 1 can be always kept constant without being influenced by the variation of the outer diameter of the heat transfer ribbon 1 wound around the ribbon feed shaft 57.

It is possible to prevent the heat transfer ribbon 1 from slacking by rotating the heat transfer ribbon feed roller 43 reversely counterclockwise as illustrated in FIG. 1 when performing the ON DEMAND operation as illustrated in FIG. 14.

That is, in the ON DEMAND operation, the paper P is cut after the rear end of the printed portion of the paper P is allowed to pass the cutter 38 after the completion of the printing on the paper P and thereafter the heat transfer ribbon 1 and the paper p are fed reversely in the direction opposite to the direction of the arrow E so as to return to the printing position. At this time, the heat transfer ribbon 1 which is brought into contact with and held between the heat transfer ribbon feed roller 43 and the heat transfer ribbon pinch roller 44 is fed reversely to prevent it from slacking by rotating the heat transfer ribbon feed roller 43 reversely by the returning amount of the heat transfer ribbon 1.

Figure 16:
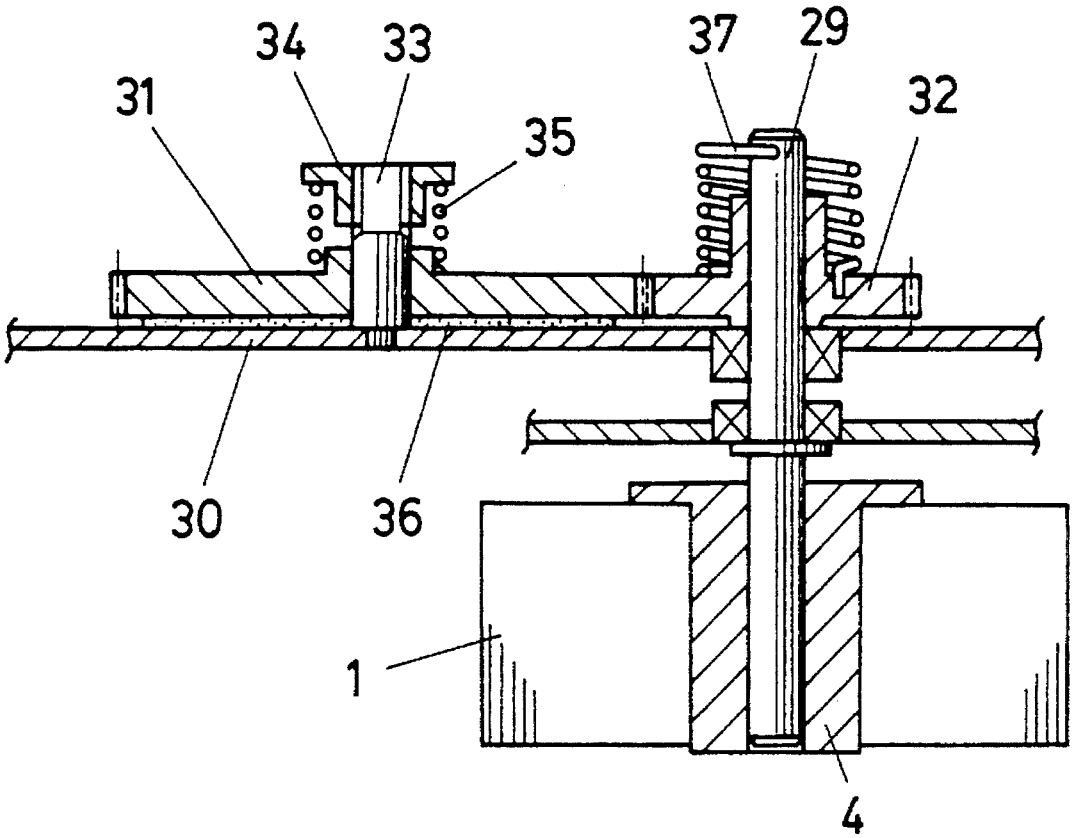
FIG. 16 is a view showing an arrangement of a mechanism which responds to an ON DEMAND operation by connecting a ribbon supply shaft to a friction transmitting gear by way of a coil spring.

With such an arrangement, it is not necessary to provide the coil spring 37 for preventing the heat transfer ribbon 1 from slacking on the mechanism to be mounted on the heat transfer ribbon feed roller 43 for giving the frictional load as explained with reference to FIG. 16 to thereby dispense with machining of the parts involved in attaching the spring 37, which leads to the reduction of the cost and to the labor for incorporating the coil spring into the thermal printer.

The thermal printer according to the present invention has a function to feed the heat transfer ribbon reversely for performing the ribbon saving function, another function to apply a tension always to the heat transfer ribbon to prevent the wrinkle from generating on the heat transfer ribbon without being influenced by the amount of the heat transfer ribbon at the supply side thereof and further function to prevent the heat transfer ribbon from slacking during the ON DEMAND operation.

The present invention has the following effects.

It is possible to always extend the heat transfer ribbon at a given tension irrespective of the amount of reduction of the heat transfer ribbon at the supply side thereof so as to prevent the wrinkle from generating on the heat transfer ribbon by adding a mechanism to the heat transfer ribbon feed roller or the heat transfer ribbon pinch roller for applying a tension directly to the heat transfer ribbon while the heat transfer ribbon is held by the heat transfer ribbon feed roller and heat transfer ribbon pinch roller which are paired.

It is also possible to facilitate the assembly of the thermal printer and improve the maintenance thereof even if the number of rollers are increased since the heat transfer ribbon feed roller and heat transfer ribbon pinch roller are paired and integrated with each other to form a pinch roller unit which is detachable relative to the thermal printer body.

Since the heat transfer ribbon can be reversely fed by the ribbon feeding means independently of the normal feeding direction, even if there appears a large blank space between the printed portions on the paper, the heat transfer ribbon can be fed reversely so as to return the non-used portion thereof to the printing position after the completion of the printing while the heat transfer ribbon is laid on top of the paper and is allowed to pass between the thermal head and the platen and thereafter the heat transfer ribbon is separated from the paper, which leads to most effective use of the heat transfer ribbon avoiding the waste thereof.

Since the unit inclination angle mechanism is provided on the pinch roller unit for inclining the advancing direction of the paper which is allowed to pass the entire pinch roller unit relative to the width direction of the paper, it can incline the entire pinch roller unit by simple operation so as to incline the advancing direction of the paper and to align the side edge of the so inclined paper to the standard surface, which leads to sure prevention of the skew of the paper.

Even if the paper is of different kind such as a thin paper, it can be prevented from skewing by adjusting the inclination angle to the optimum angle, which leads to an excellent printing.

Since there are provided in the thermal printer a thermal head pressing release mechanism for releasing the pressing of the thermal head against the platen and a pinch roller separating mechanism which is interlocked with the thermal head pressing release mechanism when the operation to release the pressing of the thermal head against the platen is performed, the paper pinch roller is moved away from the paper feed roller while the heat transfer ribbon pinch roller is moved away from the heat transfer ribbon feed roller and the paper and the heat transfer ribbon can be easily detachable by mere one operation, which leads to the improvement of the operability.

Further, since the bearings for supporting both ends of the shafts of the heat transfer ribbon pinch roller and the paper pinch roller are slidably held and these bearings are respectively pressed against and urged toward the heat transfer ribbon feed roller and the paper feed roller by the pressing means which are independent of each other so that the heat transfer ribbon pinch roller is brought into contact with the paper feed roller while they remain parallel with each other even if the parts thereof vary in the accuracy thereof, which leads to a stable feeding of the heat transfer ribbon and the paper while the heat transfer ribbon is held by the heat transfer ribbon pinch roller and the heat transfer ribbon feed roller with uniform pressing force and the paper is held by the paper pinch roller and the paper feed roller with uniform pressing force.

Having described an illustrative embodiment of the invention with reference to the accompanying drawings, it is to be understood that the invention is not limited to such a precise embodiment, and that various changes and modifications may be effected therein by one skilled in the art without departing from the scope and spirit of the invention as defined in the appended claims.

What is claimed is:

1. A thermal printer provided with a heat transfer ribbon feeding means to feed a heat transfer ribbon to the normal direction or the reverse direction opposite to the normal direction for performing printing on a paper, a platen and a thermal head which is pressed against the platen wherein the heat transfer ribbon and the paper are fed in the normal direction and allowed to pass between the platen and the thermal head while the heat transfer ribbon is laid on top of the paper so that ink impregnated in the heat transfer ribbon is molten by the thermal head to thereby perform the printing on the paper, the thermal printer further comprising:

a paper feed roller and a paper pinch roller for holding and feeding the paper toward and between the platen and the thermal head;

a heat transfer ribbon feed roller and a heat transfer ribbon pinch roller respectively provided on said heat transfer feeding means for holding and feeding the heat transfer ribbon in the reverse direction independently of the normal direction;

wherein the paper pinch roller and the heat transfer ribbon pinch roller are respectively integrated with each other to form a pinch roller unit which is detachably attached to a body of the thermal printer and wherein the paper pinch roller and the heat transfer the paper pinch roller are respectively set on the positions where the pinch roller can feed the paper and the heat transfer ribbon pinch roller can feed the heat transfer ribbon when the pinch roller unit is mounted on the body of the thermal printer.

2. A thermal printer according to claim 1 further comprising a unit inclination angle adjusting mechanism for inclining the entire pinch roller unit so as to incline the advancing direction of the paper in the width direction thereof.

3. A thermal printer according to claim 1 further comprising a thermal head pressing release mechanism for releasing the pressing of the thermal head against the platen and a pinch roller separating mechanism which is interlocked with the thermal head pressing release mechanism when the operation to release the pressing of the thermal head against the platen is performed, whereby the paper pinch roller is moved away from the paper feed roller while the heat transfer ribbon pinch roller is moved away from the heat transfer ribbon feed roller.

4. A thermal printer according to claim 1 further comprising first bearings for supporting both ends of the shaft of the paper pinch roller so as to be slidably movable toward or away from the paper feed roller, second bearings for supporting both ends of the shaft of the heat transfer ribbon pinch roller so as to be slidably movable toward or away from the heat transfer ribbon feed roller, a first pressing means for pressing the bearings against and urging the bearings toward the paper feed roller and a second pressing means independent of the first pressing means for pressing the bearing against and urging the bearing toward the heat transfer ribbon feed roller.

5. A thermal printer according to claim 2 further comprising a thermal head pressing release mechanism for releasing the pressing of the thermal head against the platen and a pinch roller separating mechanism which is interlocked with the thermal head pressing release mechanism when the operation to release the pressing of the thermal head against the platen is performed, whereby the paper pinch roller is moved away from the paper feed roller while the heat transfer ribbon pinch roller is moved away from the heat transfer ribbon feed roller.

6. A thermal printer according to claim 5 further comprising first bearings for supporting both ends of the shaft of the paper pinch roller so as to be slidably movable toward or away from the paper feed roller, second bearings for supporting both ends of the shaft of the heat transfer ribbon pinch roller so as to be slidably movable toward or away from the heat transfer ribbon feed roller, a first pressing means for pressing the bearings against and urging the bearings toward the paper feed roller and a second pressing means independent of the first pressing means for pressing the bearing against and urging the bearing toward the heat transfer ribbon feed roller.

* * * * *

UNITED STATES PATENT AND TRADEMARK OFFICE

CERTIFICATE OF CORRECTION

PATENT NO.: 5,459,504
DATED : October 17, 1995
INVENTOR(S): Nobuhiro SATO

It is certified that an error appears in the above-identified patent and that said Letters Patent is hereby corrected as shown below:

Column 19, line 20, change "the paper " to --ribbon--, and at line 21, change "the pinch" to --the paper pinch--.

Signed and Sealed this
Fourth Day of January, 2000

*Attest:*

*Attesting Officer*

*Acting Commissioner of Patents and Trademarks*